United States Patent [19]

Coester et al.

[11] 4,153,480

[45] May 8, 1979

[54] METHOD FOR FORMING AN ANTICORROSIVE OXIDE LAYER ON STEELS

[75] Inventors: Erwin Coester; Heinz Krapf, both of Jülich; Martin Pfistermeister, Düren; Bruno Sartor, Pier; Hans Mohrhauer, Jülich, all of Fed. Rep. of Germany

[73] Assignee: Uranit Uran-Isotopentrennungs-Gesellschaft mbH, Jülich, Fed. Rep. of Germany

[21] Appl. No.: 852,569

[22] Filed: Nov. 17, 1977

[30] Foreign Application Priority Data

Nov. 17, 1976 [DE] Fed. Rep. of Germany ..... 2652293

[51] Int. Cl.[2] ..... C23F 7/04

[52] U.S. Cl. ..... 148/6.35; 148/31.5; 252/373

[58] Field of Search ..... 134/31; 148/16, 6.35

[56] References Cited

U.S. PATENT DOCUMENTS

| | | | |
|---|---|---|---|
| 1,105,251 | 7/1914 | Carnahan | 148/6.35 |
| 1,346,473 | 7/1920 | Swan | 148/6.35 |
| 2,543,710 | 2/1951 | Schmidt et al. | 148/6.35 |
| 3,954,512 | 5/1976 | Kanter | 148/6.35 |

FOREIGN PATENT DOCUMENTS

| | | | |
|---|---|---|---|
| 1621509 | 11/1971 | Fed. Rep. of Germany | 148/6.35 |
| 2503763 | 7/1977 | Fed. Rep. of Germany | 148/6.35 |
| 1283081 | 7/1972 | United Kingdom | 148/6.35 |
| 1198650 | 7/1970 | United Kingdom | 148/6.35 |

OTHER PUBLICATIONS

Grobner et al., Chem. Zentralbl, (1960).

*Primary Examiner*—Ralph S. Kendall
*Attorney, Agent, or Firm*—Spencer & Kaye

[57] ABSTRACT

A method is provided for forming an anti-corrosive oxide layer on steel. The steel surface is subjected to superheated steam for a period of one to several hours. Before subjecting the steel to the superheated steam, the steel surface is initially subjected to a gaseous formic acid atmosphere at a raised temperature of up to 480° C. The treatment with superheated steam takes place during a further heating period in which a temperature between 450° C. and 520° C. is maintained under steam flow-through conditions in which the steam flow has a Reynolds number greater than 900.

12 Claims, No Drawings

METHOD FOR FORMING AN ANTICORROSIVE OXIDE LAYER ON STEELS

BACKROUND OF THE INVENTION

The present invention relates to a method for producing an anti-corrosive oxide layer on steel, and more particulary, relates to a method in which the steel surface is subjected to superheated steam for a period of one to several hours.

A process for forming an anti-corrosive oxide layer on steel by subjecting the steel surface to superheated steam is known from the German Auslegeschrift No. 1,621,509. According to this process, a corrosion preventing, protective layer of $Fe3O_4$ is formed by conducting superheated steam, of at least 250° C., through pipelines, apparatus, and vessels of steam power plants. The protective layer formed in this manner, however, does not withstand all chemical influences. Furthermore, undesirable hydrogen embrittlement can occur when using this above mentioned method.

In copending U.S. application Ser. No. 650,759, filed on Jan. 20th, 1976, by Pfistermeister et al, and assigned to the same assignee as the present application, there is disclosed a method for producing an anticorrosive oxide layer on steel in which a clean steel surface is subjected to superheated steam for a period of at least one hour. In that method, the clean steel surface, before being subjected to the steam, is first heated to a temperature of at least 200° C. in an air or oxygen atmosphere, and this heating removes organic impurities. The so-heated steel is then subjected to a further heating period in which a temperature between 450° C. and 520° C. is reached and maintained and during this further heating the steel is treated with superheated steam of a corresponding temperature between 450° C. and 520° C. under flow conditions in which the flow has a Reynolds number of greater than 900. During the steam treatment, a protective spinel layer is formed on the steel. After the steam treatment, the steel can be cooled. The above-identified application further discloses that if the steel is contaminated with a thin oxide layer, the steel can initially be heated in an $H_2$ or $NH_3$ atmosphere.

It has been now found, however, that in spite of careful cleaning of the steel surfaces, the formation of undersirable thin oxide layers before the steam treatment in the method described in application Ser. No. 650,759 could not be prevented in all cases, and these thin oxide layers interfere with the actual protective layer formation that occurs during the treatment with the superheated steam. In order to remove these thin oxide layers, it is known to use a reducing gas such as hydrogen or carbon monoxide. The use of such gases in large amounts, however, has the drawback that extensive safety provisions have to be made with respect to the danger of explosion or poisoning, respectively. This also increases the danger of hydrogen embrittlement. Furthermore, not all oxides can be reduced, for example, with carbon monoxide.

SUMMARY OF THE INVENTION

It is a primary object of the present invention to directly remove possible oxide layers on steel surfaces in a technically simple and harmless manner before a steam treatment which produces a protective layer so that a perfect surface is produced with which more favorable conditions for the subsequent spinellization can be realized.

A further object of the present invention is to provide a method to protect steel better than previously possible against the attack of very aggressive media without thereby impairing the mechanical properties of the steel.

Another object of the present invention is to provide a method to better protect steel against gases which have a strongly fluorinating effect, such as, for example, uranium hexafluoride.

Additional objectives and advantages of the present invention will be set forth, in part, in the description which follows and in part will be obvious from the description or can be learned by practice of the invention. The objectives and advantages are achieved by means of the processes, instrumentalities and combinations particularly pointed out in the appended claims.

To achieve the foregoing objectives, the present invention provides a method for forming an anti-corrosive oxide layer on steel in which the steel surface is subjected to superheated steam for a period of at least one hour, and which comprises heating a steel surface in a gaseous formic acid atmosphere to a raised temperature up to 480° C., and then subjecting the heated steel to a further heating period in which a temperature between 450° C. and 520° C. is maintained, with superheated steam under steam flow-through conditions in which the steam flow has a Reynolds number greater than 900.

It is to be understood that both the foregoing general description and the following detailed description are exemplary but are not restrictive of the invention.

DETAILED DESCRIPTION OF THE INVENTION

The steels treated in accordance with the process of the present invention are preferably maraging steels, but other steels can also be treated. Preferably, the maraging steels contain besides iron the main components Ni, Co, Mo and Ti in various proportions, which are dependent on the application. The particular alloying elements are not so important for the process itself; the determining factor is the application. The weight percentage range for the maraging steel components generally are:

Ni 10–26,
Co 6–18,
Mo 2–12
and Ti 0.5–2.0

An example of another steel that can be treated in the process of the present invention is the steel 15Mo3 which has 0.15% carbon content and 0.39% molybdenum content.

The steels which are treated in accordance with the present invention can be treated in their as-received, cleaned form from their manufacturer and before they have been subjected to corrosive media or can be steels which have surfaces that are contaminated with oils, greases or other substances arising from the manufacturing process, or can be steels which are initially contaminatd with a thin oxide layers, such as an oxide layer in the range of 500 to 1000 Å, or less. So far, we have not encountered initial oxide layers thicker than 1000Å, from our manufacturers.

In the practice of the present invention, the steel surface is heated in a formic acid atmosphere to a raised temperature up to 480° C. The raised temperature achieved during the formic acid treatment preferably is in the range of 400° C. to 480° C., especially when the steel surfaces initially contain a thin oxide layer of 500 to 1000Å. Generally, the steel is heated to a temperature of at least 450° C. during the formic acid treatment. The heating in the formic acid atmosphere can raise the steel from an ambient temperature of, for example, about 25° C. to the desired temperature range of, for example, 400 to 480° C. Generally, the steel is subjected to the formic acid treatment for a period of time from 20 minutes to 60 minutes. During this initial formic acid treatment, the steel is not subjected to steam treatment. The formic acid preferably is mixed with an inert gas, such as nitrogen or argon, which serves as a carrier gas. The formic acid atmosphere can contain 4 to 5 volume parts of the carrier to one (1) volume part of formic acid.

Handling of formic acid is relatively harmless. The acid does not decompose until it is heated far above room temperature, such as at a temperature above 780° C., for example, in a fluidized bed furnace, and then forms carbon dioxide and hydrogen which reduces any initial oxide layer that is present on the steel surface. Possible Me formates formed on the surface areas decompose into spinels at temperatures higher than 400° C. It has been found that due to the formic acid pretreatment according to the present invention, the surface protective layer produced during the subsequent steam treatment contains a considerably reduced number of defects as compared to protective layers formed without the pretreatment of the present invention.

Upon reaching the desired raised temperature of up to 480° C., the heated steel is then subjected to treatment with superheated steam. If the initial treatment with formic acid has raised the temperature of the steel to 450° C. or higher, the steam treatment is preferably selected to maintain the steel temperature achieved during the formic acid treatment or to raise the steel to a still higher temperature within the range up to 520° C. If the initial treatment with formic acid has not raised the temperature of the steel to 450° C., the treatent with superheated steam raises the temperature of the steel to the range of 450° to 520° C.

Once the steel has reached the desired temperature for the steam treatment within the range of 450° C. to 520° C., the steel is maintained by the superheated steam at this temperature. Preferably, the steel is maintained at a temperature of about 450° C. to 520° C. by the superheated steam for a period of from about 1 to 5 hours.

During the treatment with the superheated steam, the flow conditions should be as turbulent as possible. Generally, the Reynolds number of the flow must be at least 900, but the optimum range is from about 2100 to 2500. The treatment with superheated steam under flow conditions where the Reynolds number is greater than 900 prevents hydrogen embrittlement since no equilibrium state then can form which would permit successive penetration of the hydrogen into the steels. During the steam treatment, an oxide layer is formed which can consist of the mixed and pure spinels of the type Fe ($Fe_2O_4$), Ni ($Fe_2O_4$), Ni ($Co_2O_4$), Co ($Co_2O_4$), and $Fe_4Mo_6O_{16}$.

After the steam treatment, the steel is cooled to about 100° C. by subjecting the steel, for several hours, to a gas stream having a temperature which can be adjusted in the range of 10° C. to 30° C. It is desirable to use nitrogen instead of air for the cooling down process to prevent further oxidation of the oxide layer.

The entire process of the present invention including the initial heating in the formic acid atmosphere, the super-heated steam treatment, and the cooling, can take place in an accurately regulatable fluidized bed furnace. The steam used during the superheated steam treatment may have added to it nitrogen, air or oxygen in the volume ratios $H_2O:N_2$ or air or $O_2$ of no more than 4:1 or 5:1. The best results are obtained, however, with steam which is completely free of inorganic and organic nilsources, nitrogen, air or oxygen, respectively.

In the process of the present invention, a protective layer is formed which contains mixed oxides that are formed during the process and which are directly connected with the underlying base material by main valence bonding and hence produce excellent adhesion. The protective layer that is formed is a continuous, homogeneous, dense and nonporous protective layer which effectively prevents the diffusion of hydrogen and thus prevents possible hydrogen embrittlement.

With the process of the present invention, the corrosion rate on steel at 125° C. in a $UF_6$ atmosphere and low proportions of HF (0.1 to a maximum of 5 mol %) can be reduced at least by a factor of 50 compared to untreated surfaces. This means that, in a $UF_6$-HF atmosphere, the amount of uranium fluoride deposits that will be formed on steel surfaces becomes much smaller. Thus, the efficiency and lifetime of $UF_6$ processing systems, particularly that of the rotors of gas ultracentrifuges, is no longer seriously imparied by corrosion. Moreover, any required uranium decontamination can either be completely eliminated or becomes much simpler.

Variation in the treatment periods permits adjustment of the thickness of the protective layer between 0.4 and 3 $\mu$, such as 0.7 to 3 $\mu$. Normally, use of longer steam treatment periods produces thicker protective layers. With the formic acid treatment of the present invention, protective layers of, for example, about 0.8$\mu$ can be produced more quickly than normally the case. Likewise, weld seams can be protected simultaneously with the process of the invention without any loss in quality.

By use of formic acid to pretreat the steel surfaces, the reaction time with steam is found to be much lower than with untreated steels and with steels treated with other gases, e.g. a layer thickness of 2.5 $\mu$ was already obtained in 90 minutes with steam, compared to the normal 5 hours.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

Normal maraging steel samples which may have blue and/or yellow annealing colors as well as rust pits, were heated from 20° C. to 480° C. in a regulatable fluidized-bed furnace within 40 to 60 minutes, by means of a mixture of $N_2$/formic acid in a volume ratio of 5:1 and with a flow speed of 5 l/min. Upon reaching 480° C., the treatment was continued for 30 minutes with a gas mixture of $N_2$/formic acid in a volume ratio of 4:1 and a flow speed of 7 l/min. Thereafter, the formic acid content was adjusted to zero with a gradual switchover to superheated steam (10–15 min). The steam treatment took place under turbulent conditions at 480° C., during 2.5 hours. Cooling to 100° C. took place in the nitrogen stream. Compared with untreated samples, the thus treated samples distinguish themselves in the corrosion test by a very high protection factor of about 90 to 110. The layer thickness was about 0.8 to 0.9 $\mu$.

EXAMPLE 2

A clean maraging steel sample (NiCoMo) was heated to 480° C. in an accurately regulatable fluidized bed furnace during a period of 60 minutes. In this 60-minute period, the heating initially took place in a formic-acid nitrogen atmosphere with 3 vol% formic acid to bring the steel to a temperature of 200° C. within 20 minutes. Afterwards the formic-acid concentration in nitrogen was raised to 20 vol% and heating was continued to reach 460° C. in another 40 minutes. After having reached this level heating then took place with 21 $Nm^3/h$ superheated steam (Re=2100) to bring the heated steel to a temperature of 480° C. The change-over from the nitrogen formic-acid mixture to superheated steam was carried out firstly by the exclusion of formic-acid gas and secondly by the gradual displacement of nitrogen by superheated steam. This steam treatment was continued for 2 hours at 480° C. Thereafter, the steel was cooled to 100° C. in a stream of nitrogen of greater than 20 $Nm^3/h$ during a period of time of about 3 hours. A microcrystalline firmly adhering mixed oxide layer was formed which had a thickness of about 0,8 $\mu$m, and which consisted of mixed and pure spinels of the type $Fe(Fe_2O_4)$, $Ni(Fe_2O_4)$, $Ni(Co_2O_4)$, $Co(Co_2O_4)$, and $Fe_4Mo_6O_{16}$, with an average lattice constant of 8.4 Ang. The mechanical properties of the heated sample, such as tensile strength, modulus of elasticity and coefficient of expansion, remained fully unchanged. The $H_2$ content of the treated sample was less than 1 ppm. A number of steel samples were treated in a similar manner, and the $H_2$ content of the treated samples was always less than 1 ppm. The samples also distinguished themselves by a high protection factor of 120–130. The average layer thickness was determined by weighing the samples and gave a value of 0.7–0.8 $\mu$m.

It will be understood that the above description of the present invention is susceptible to various modifications, changes and adaptations, and the same are intended to be comprehended within the meaning and range of equivalents of the appended claims.

What is claimed is:

1. In a method for forming an anti-corrosive oxide layer on steel, in which the steel surface is subjected to superheated steam for a period of at least one hour, the improvement comprising heating the steel surface to a temperature of above 180° C. up to 480° C. in a gaseous formic acid atmosphere, and then subjecting the heated steel to a further heating period of 1 to 5 hours in which a temperature between 450° C. and 520° C. is maintained, with superheated steam under flow conditions in which the flow has a Reynolds number of greater than 900.

2. The method as defined in claim 1 wherein the formic acid is mixed with an inert gas as a carrier gas.

3. The method as defined in claim 2 wherein the carrier gas is nitrogen or argon.

4. The method as defined in claim 2 wherein the steel is cooled to a temperature of about 100° C.

5. The method as defined in claim 2 wherein the heating and cooling are effected in a regulatable fluidized bed furnace.

6. The method as defined in claim 1 wherein, after the steam treatment, the steel is cooled for several hours in a gas stream with regulatable temperature.

7. The method as defined in claim 1 wherein the heating is effected in a regulatable fluidized bed furnace.

8. The method as defined in claim 1 wherein the steel is a maraging steel.

9. The method as defined in claim 1 wherein the superheated steam flow is turbulent.

10. The method as defined in claim 1 wherein the Reynolds number is from about 2100 to 2500.

11. The method as defined in claim 1 wherein the oxide layer comprises mixed oxides.

12. The method as defined in claim 1 wherein the oxide layer comprises mixed and pure spinels of $Fe(Fe_2O_4)$, $Ni(Fe_2O_4)$, $Ni(Co_2O_4)$, $Co(Co_2O_4)$ and $Fe_4Mo_6O_{16}$.

* * * * *